US005502353A

United States Patent [19]

Mako et al.

[11] Patent Number: 5,502,353

[45] Date of Patent: Mar. 26, 1996

[54] APPARATUS FOR BUNCHING RELATIVISTIC ELECTRONS

[75] Inventors: Frederick M. Mako, 6308 Youngs Branch Dr., Fairfax Station, Va. 22039; Terry F. Godlove, 9713 Manteo Ct., Fort Washington, Md. 20744

[73] Assignees: Frederick M. Mako, Fairfax Station, Va.; Terry F. Godlove, Fort Washington, Md.; Ansel M. Schwartz, Pittsburgh, Pa.

[21] Appl. No.: 293,580

[22] Filed: Aug. 22, 1994

Related U.S. Application Data

[63] Continuation of Ser. No. 828,413, Jan. 31, 1992, abandoned.

[51] Int. Cl.[6] ..... H01J 23/10; H01J 25/02

[52] U.S. Cl. ..... 315/5; 315/5.26; 315/5.27; 315/5.35

[58] Field of Search ..... 315/4, 5, 5.25, 315/5.26, 5.27, 5.28, 5.35; 331/79, 80, 81

[56] References Cited

U.S. PATENT DOCUMENTS

| | | | |
|---|---|---|---|
| 2,272,165 | 2/1942 | Varian et al. | 315/5.28 |
| 2,409,179 | 10/1946 | Anderson | 315/5.28 |
| 2,469,964 | 5/1949 | Hartman | 315/5.24 X |
| 2,470,856 | 5/1949 | Kusch | 315/5.28 X |
| 2,534,537 | 12/1950 | Sziklai | 315/5.28 |
| 2,938,139 | 5/1960 | Lerbs | 315/5.26 |
| 3,237,047 | 2/1966 | Webster | 315/5.37 X |
| 3,514,656 | 5/1970 | Fisk | 315/5.35 X |
| 4,617,493 | 10/1986 | Lau | 315/5 |
| 4,743,804 | 5/1988 | Frost et al. | 315/4 X |

FOREIGN PATENT DOCUMENTS

| | | | |
|---|---|---|---|
| 8601032 | 2/1986 | WIPO | 315/5 |

OTHER PUBLICATIONS

Wessel–Berg, T; "A new concept for generation of multi–megawatt power approaching 100% conversion efficiency"; *1977 Int'l Electron Dev Meeting Proc;* Wash D.C.; 5–7 Dec. 1977, pp. 238–241.

*Primary Examiner*—Benny T. Lee
*Attorney, Agent, or Firm*—Ansel M. Schwartz

[57] ABSTRACT

The present invention is based on a relatively simple mechanism which heretofore has not been tried before. The mechanism depends on modulation of a collimated beam transverse to the beam direction rather than the usual longitudinal modulation. Conversion of the transverse motion into longitudinal bunching in an output cavity is accomplished by means of the difference in path length in a bending magnet. Since the present invention does not depend on longitudinal modulation, it is suitable for pulsed superpower (1 GW) applications, but it can be equally suited for multi-megawatt cw applications. The present invention pertains to an apparatus for bunching relativistic electrons. The apparatus comprises means for imparting a periodic velocity in a first direction in a first region to electrons of an electron beam moving in a second direction. The apparatus also is comprised of means for causing electrons to follow a path length in a second region corresponding to the velocity in the first direction such that the path length is determined by the velocity imparted in the first direction. The differing path length causes beam electrons to be bunched as they exit the second region, allowing microwave power to be extracted from the bunches by conventional means.

2 Claims, 9 Drawing Sheets

APPARATUS FOR BUNCHING RELATIVISTIC ELECTRONS

This is a continuation of application Ser. No. 07/828,413, filed on Jan. 31, 1992, now abandoned.

FIELD OF THE INVENTION

The present invention is related to microwave amplifiers. More specifically, the present invention is related to the bunching of relativistic electrons. Bunching is accomplished by first transversely modulating a collimated electron beam. Once modulated, the beam is allowed to pass through a bending magnet which converts the modulated beam into a bunched beam.

BACKGROUND OF THE INVENTION

The development of high-power microwave sources has proceeded slowly over several decades, motivated by different applications at different times. Immediately after World War II, for example, tubes which had been developed for radar and for high-power transmitters were needed to power high-energy particle accelerators. The most dramatic development took place at Stanford University. It was there that the klystron was rapidly developed from the kilowatt level to peak powers exceeding a megawatt. After further development the klystron rapidly became the accepted power tube for a large number of electron accelerators as well as many other applications. It has been developed to the point where reliable tubes produce 50 megawatts peak power and research devices achieve 200 MW at 11.4 GHz for about 10 nanoseconds. T. G. Lee, G. T. Konrad, Y. Okazaki, Masaru Watanabe, and H. Yonezawa, IEEE Trans. Plasma Sci., PS-13, No. 6, 545 (1985), and M. A. Allen et al., LINAC Proc. 508 (1989) CEBAF Report No. 89-001.

Klystrons and gridded tubes provide for most high-power microwave needs. However, they have definite drawbacks for particular applications. Gridded tubes are severely limited in frequency. Power density, gain and efficiency problems rapidly get worse above 100 Mhz. High-power klystrons also have limitations:

they become very large and expensive for the lower frequency range of interest. One solution advanced by Varian Associates is the Klystrode. M. B. Shrader and D. H. Priest, IEEE Trans. Nucl. Sci. NS-32, 2751 (1985); M. B. Shrader, Bull. Am. Phys. Soc. 34, 236 (1989). This device combines some of the features of gridded tubes and klystrons.

For high-power amplifiers, an awkward frequency region exists between approximately 100 MHz and 2 GHz. Moreover, at any frequency, as the peak power increases, designers are forced to use higher voltage to keep the beam current and resulting space charge effects within limits. This means that they are forced to use increasingly relativistic beams which are difficult to axially modulate. In general, it is difficult to achieve high power, high efficiency, high gain, small size/weight, and low cost simultaneously.

Interest has increased in recent years in other methods of microwave generation. A group led by V. Granatstein at the University of Maryland is pursuing the cyclotron maser mechanism for use in a gyroklystron amplifier. Victor L. Granatstein, IEEE Cat. No. 87CH2387-9, 1696 (1987). Another group led by J. Pasour, J. A. Pasour and T. P. Hughes, Bull. Am. Phys. Soc. 34, 185 (1989), is experimenting with the negative mass instability mechanism proposed by Y. Y. Lau, Y. Y. Lau, Phys. Rev. Lett. 53, 395 (1984). Groups at the Stanford Linear Accelerator Center (SLAC), Lawrence Berkeley Laboratory (LBL), and Lawrence Livermore National Laboratory (LLNL) are collaborating on a relativistic klystron project, T. L. Lavine et al., Bull. Am. Phys. Soc. 34, 186 (1989); R. F. Koontz et al., Bull. Am. Phys. Soc. 34, 188 (1989). And recently at Novosibirsk, USSR, where Budker invented the gyrocon, impressive results have been obtained with a version of the gyrocon called the magnicon, M. M. Karliner et al., Nucl. Inst. Meth. A269, 459 (1988).

None of these devices is near commercial production. Further research is required to sort out their relative merits and practical benefits. Reviews by Reid and by Faillon for the accelerator community give summaries of much of the above effort, D. Reid, Proc. 1988 Linac Conf., 514 (1989) CEBAF Report No. 89-001; G. Faillon, IEEE Trans. Nucl. Sci. NS-32, 2945 (1985).

SUMMARY OF THE INVENTION

The present invention is based on a relatively simple mechanism which heretofore has not been tried before. The mechanism depends on modulation of a collimated beam transverse to the beam direction rather than the usual longitudinal modulation. Conversion of the transverse motion into longitudinal bunching in an output cavity is accomplished by means of the difference in path length in a bending magnet. Since the present invention does not depend on longitudinal modulation, it is suitable for pulsed superpower (1 GW) applications, but it can be equally suited for multi-megawatt cw applications.

The present invention pertains to an apparatus for bunching relativistic electrons. The apparatus comprises means for imparting a periodic velocity in a first direction in a first region to electrons of an electron beam moving in a second direction. The apparatus also is comprised of means for causing electrons to follow a path length in a second region corresponding to the velocity in the first direction such that the path length is determined by the velocity imparted in the first direction. The differing path length causes beam electrons to be bunched as they exit the second region, allowing microwave power to be extracted from the bunches by conventional means.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

The following defines the parameters used throughout the description of the preferred embodiment.

Note: The deflection cavity is also known as the input cavity.

$\nu_1$=rotation angle of the uniform bend magnet 24 at the input edge 26

$\nu_2$=rotation angle of the uniform bend magnet 24 at the output edge 28

$\nu$=rotation angle of the bend magnet 24 when the input and output edge angles are equal, i.e. $\nu_1=\nu_2=\nu$.

$\alpha$=bend angle of the bend magnet 24

$\theta$=the particle deflection angle that is measured from the path travelled by a particle that did not experience a deflecting field from the input cavity.

$\theta_m$=the maximum deflection angle ($\theta$)

$\Delta\theta$=indicates that the deflection angle is a small quantity n=index number B=the bend magnet 24 field strength as a function of radial position in the magnet when the bend magnet has a finite index number (n)

$B_b$=bend magnet 24 field strength maximum and is constant spatially $\Delta S$=difference in path length for a particle that travels at zero deflection angle ($\theta$=0) as compared to a particle that has a finite deflection angle of $\Delta\theta$ $L_1$=distance from deflection cavity center to entrance position of the bend magnet, also known as object distance $L_2$=distance from output cavity center to exit position of the bend magnet, also known as the image distance L=the object distance and image distance when $L_1=L_2$.

Figure 1:
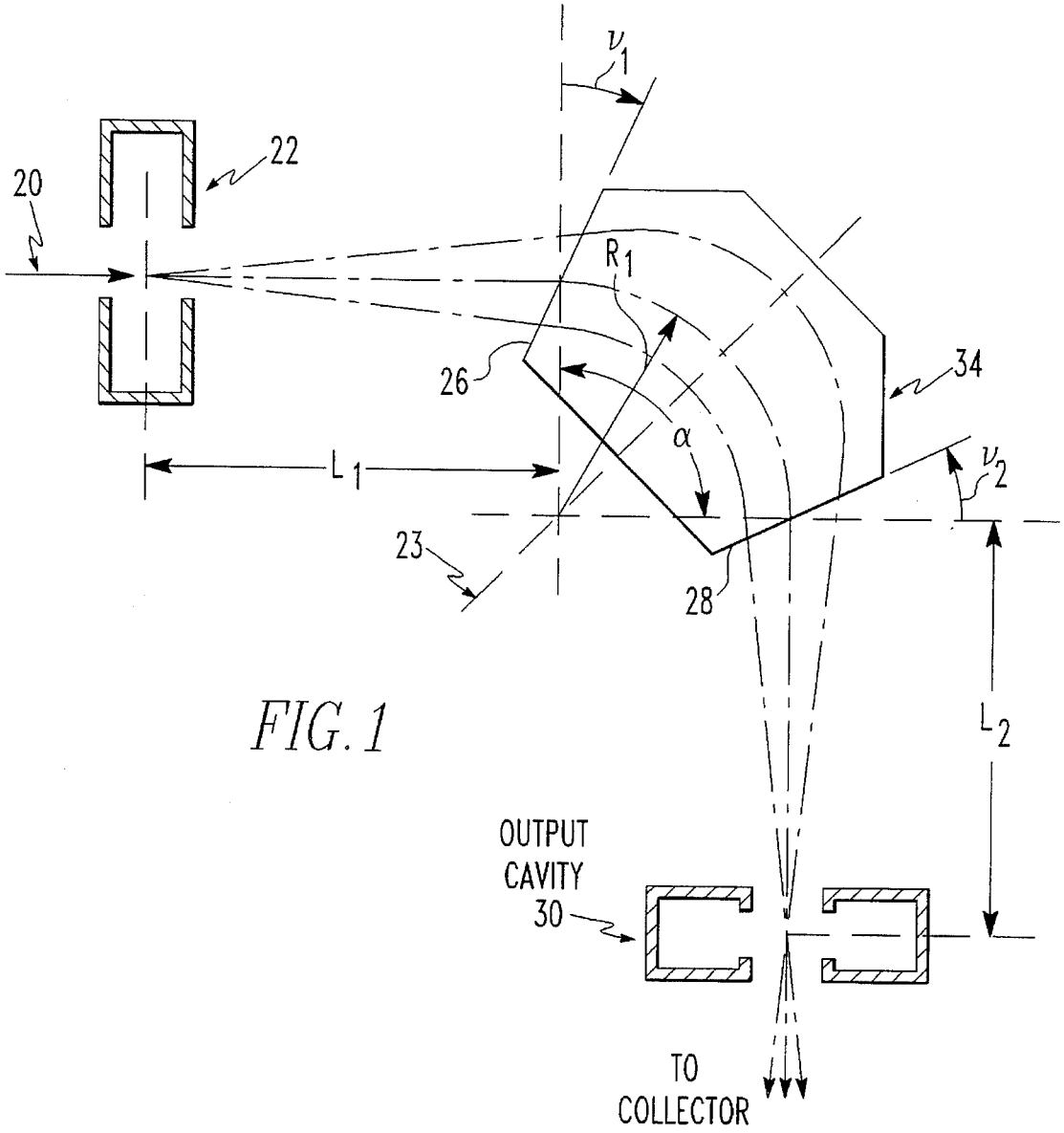
FIG. 1 is a schematic representation of an embodiment of the present invention.

$B_x$=the time dependent rf magnetic field strength that points in the x-direction $B_{rf}$=the maximum value of the rf magnetic field strength $B_x$ e=the charge of an electron m=the mass of an electron $B_y$=vertical magnetic field $B_A$=axial magnetic field $\gamma$=relativistic mass factor $\Omega_{rf}$=gyro-frequency of an electron in the magnetic field $B_{rf}$ $E\rho$=radial electric field strength from an electron beam in a conducting pipe $B\theta$=azimuthal magnetic field strength from an electron beam in a conducting pipe k=wave number $\omega$=oscillating frequency in radians/sec $\delta n$=electron beam principal density perturbation $n_o$=change in the uniform density ($n_t$) by the amount of $\delta n$ $\delta r$=particle radial displacement from equilibrium $\delta r'$=first time derivative of $\delta r$ $\delta r''$=second time derivative of $\delta r$ $\delta z$=particle axial displacement from equilibrium $\delta z'$=first time derivative of $\delta r$ $\delta z''$=second time derivative of $\delta r$ $\delta y$=particle transverse displacement from equilibrium $\delta y'$=first time derivative of $\delta y$ $\delta y''$=second time derivative of $\delta y$ $\partial r=\delta r$ $\partial y=\delta y$ Referring now to the drawings wherein like reference numerals refer to similar or identical parts throughout the several views, and more specifically to FIG. 1 thereof, there is shown a schematic diagram of the present invention is shown in FIG. 1. A preferably small diameter, well collimated beam 20 traverses an input cavity 22 which operates in a mode having a magnetic field perpendicular to the plane of the figure. The amplitude of the field is adjusted to maximize the deflection angle $\theta_m$. After traveling a drift distance $L_1$, the oscillating beam enters a bending magnet 24 in the median plane of the magnet and is bent through an angle $\alpha$, with a radius of curvature R, determined by the kinetic energy and applied magnetic field.

The magnet 24 of FIG. 1 is designed to be focusing in the plane perpendicular to the plane of the figure as well as in the median plane. For a uniform-field magnet 24 this is done by rotating the input edge 26 and output edge 28 by the angles $\nu_1$ and $\nu_2$, respectively, in the sense shown in FIG. 1. In the simplest embodiment, $\nu_1=\nu_2$. Edge rotation has the net effect of reducing the focusing power in the median plane and introducing focusing in the normal plane, Harald A. Enge, Chapter "Deflecting Magnets" in "Focusing of Charged Particles" Vol. II, Academic Press, Ed. A. Septier, (1967); Hermann Wollnik, "Optics of Charged Particles," Academic Press (1987) and T. F. Godlove and W. L. Bendel, Rev. Sci. Inst. 36, 909 (1965). If the magnet 24 is designed to provide equal object and image distance, $L_1=L_2=L$, then mirror symmetry exists about a plane normal to the median plane (the symmetry plane 23) through the center of the magnet as shown in FIG. 1. For a monoenergetic, well collimated beam 20 and small space charge, all rays from the center of the input cavity 22 are focused to the center of the output cavity 30, independent of the deflection angle $\theta$ up to the point where magnet aberrations become important.

It should be noted that the center of curvature of each orbit lies in the symmetry plane 23 as well as in the median plane. This means that the angle traversed by each ray within the magnet is given simply by ($\alpha+2\theta$). The distance from the center of the input cavity 22 to the (rotated) edge of the magnet 24 is $L/(\cos\theta-\sin\theta\tan\nu)$. The total path length, S, traversed between cavity centers is then given by:

$$S=(\alpha+2\theta)R+2L(\cos\theta'-\sin\theta\tan\nu)^{-1} \quad (1)$$

To determine the deflection angle, $\theta$, required for bunching, the change in travel time compared to $\theta$=0 is calculated and set equal to one-quarter of the rf period. For small $\theta$, S and $\Delta S$ may be approximated by:

$$S=\alpha R+2L+2(R+L\tan\nu)\theta \quad (2)$$

and $$\Delta S=2(R+L\tan\nu)\Delta\theta \quad (3)$$

Dividing Eq. (3) by the electron velocity, v, to obtain the difference in travel time, and setting it equal to a quarter period (=$\lambda$/4c), where $\lambda$ is the operating wavelength, the deflection angle for optimum bunching is obtained and is:

$$\theta_m=\Delta\theta=(1/8)(\beta\lambda/R)[1+(L/R)\tan\nu\}^{-1} \quad (4)$$

where $\beta$=v/c.

Equation (4) can be carried one step further. It turns out that L/R and $\nu$ are determined by the choice of bending angle, $\alpha$, and in fact are correlated in such a way that the quantity 1+ (L/R)tan$\nu$ always equals two, neglecting fringe field effects (Table I, below, gives this parameter in more detail). Eq. (4) then simplifies to:

$$\theta_m=\beta\lambda/(16R) \quad (5)$$

These equations determine the basic wavelength scaling of the invention. For example, if a conservative limit on $\theta_m$ of 7° is assumed, and the criterion is adopted that the path length should be kept as short as possible to reduce space charge effects, then the bend radius R falls in the range $\beta\lambda/2$ to $\beta\lambda$. Setting it at $\beta\lambda/2$ fixes the path length, Eq. (2), at:

$$S=\beta\lambda[(\alpha/2)+(L/R)+0.245] \quad (6)$$

which is $4.2\beta\lambda$, $3\ \beta\lambda$, and $2\ 5\beta\lambda$ for $\alpha=60°$, 90°, and 120°, respectively, taking L/R from Table I, below.

Table I gives magnet design parameters for uniform-field bending magnets 24 with equal rotation of input and output edges, and equal object and image distance.

TABLE I

| | Uniform Field Magnets | | | |
|---|---|---|---|---|
| α | fg/R | v | L/R | 1+(L/R) tanv |
| 60° | 0 | 16.1° | 3.47 | 2.00 |
| | 0.05 | 17.5° | 3.82 | 2.20 |
| | 0.10 | 18.9° | 4.27 | 2.46 |
| | 0.15 | 20.4° | 4.86 | 2.81 |
| 90° | 0 | 26.6° | 2.00 | 2.00 |
| | 0.05 | 27.9° | 2.12 | 2.12 |
| | 0.10 | 29.3° | 2.27 | 2.27 |
| | 0.15 | 30.7° | 2.47 | 2.47 |
| 120° | 0 | 40.9° | 1.16 | 2.00 |
| | 0.05 | 42.0° | 1.21 | 2.09 |
| | 0.10 | 43.4° | 1.27 | 2.20 |
| | 0.15 | 44.7° | 1.35 | 2.34 |

In order to obtain Table I, fringe field effects are included in the parameter fg, where g is the gap spacing and f is a dimensionless constant, related to the location of the (assumed) thin lens which provides focusing in the transverse plane, Harald A. Enge, Chapter "Deflecting Magnets" in "Focusing of Charged Particles" Vol. II, Academic Press, Ed. A. Septier, (1967); Hermann Wollnik, "Optics of Charged Particles," Academic Press (1987). It is typically 0.4 to 0.5. The values of Table I include the first order effect of the fringe field, but not higher order aberrations. These can be reduced by machining the input edge 26 slightly convex in shape, Harald A. Enge, Chapter "Deflecting Magnets" in "Focusing of Charged Particles" Vol. II, Academic Press, Ed. A. Septier, (1967); Hermann Wollnik, "Optics of Charged Particles," Academic Press (1987). That is, the required edge rotation angle is not strictly constant, but increases slightly as θ increases.

The parameter 1+(L/R)tanv which occurs in Eq. (4) is included in Table I to show the relatively small variation of this parameter due to finite fringe field effects.

Comparing different values of α, 120° is optimum because it gives the shortest path length. At this point, the edge angle rotation is large, 41°, and should not be increased further because of serious aberrations in the magnet 24. Also, the decrease in path length is only bout 20% compared to the 90° case. Second, the fringe field changes the magnet edge rotation by typically 2 to 3 degrees, and increases the path length by 5%–15%. These corrections, while important, are quite tolerable. Finally, it is interesting to note that for small gaps the deflection angle for optimum bunching, Eq. (5), is independent of α.

Figure 2:
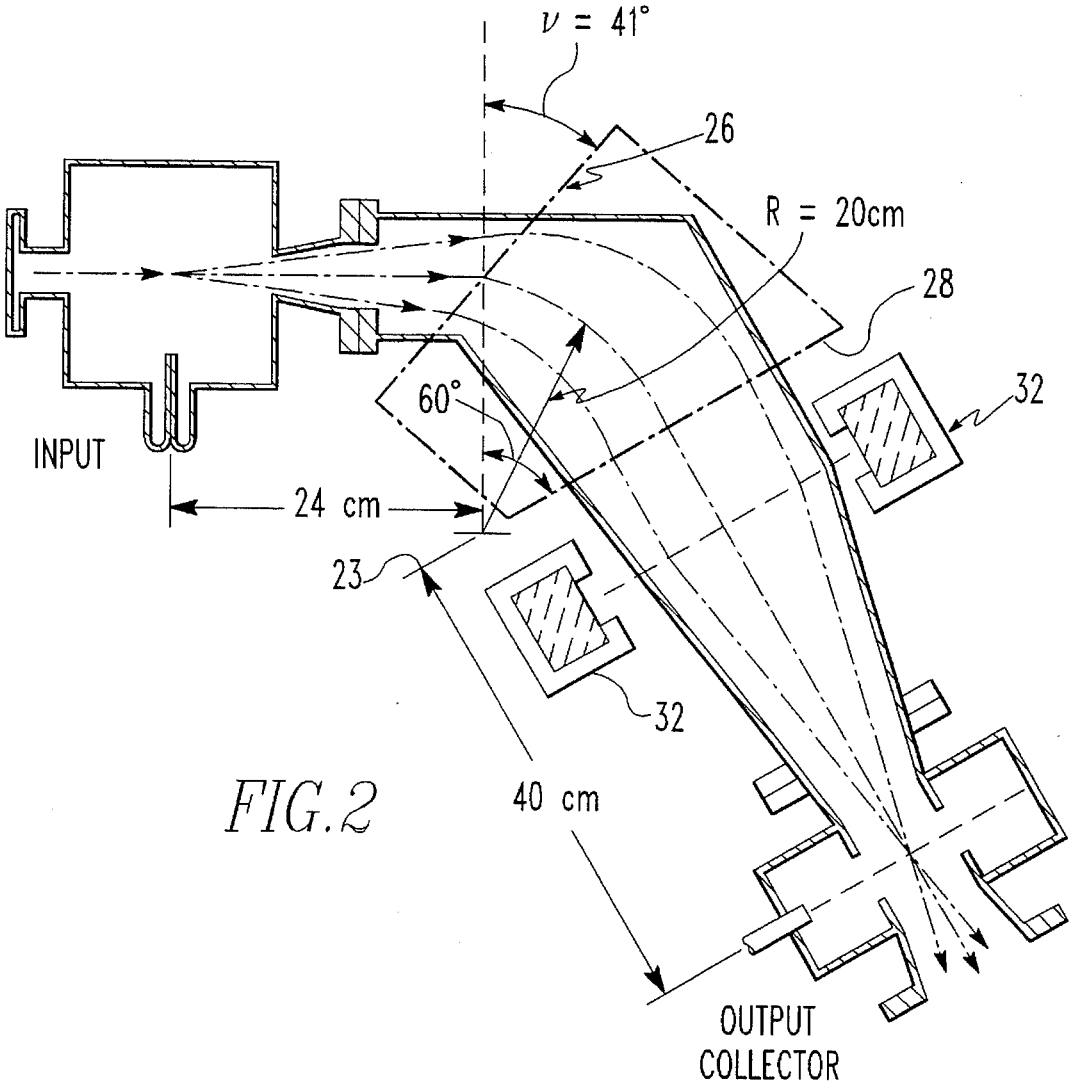
FIG. 2 is an alternative embodiment of the present invention.

FIG. 2 shows an alternative embodiment of the invention. The collimated beam 20, input cavity 22, magnet 24 and output cavity 30 have the same description as given for FIG. 1. Furthermore, FIG. 2 is identical to using α=120°, up to the plane of symmetry 23 in the magnet 24 of FIG. 1. The second half of the magnet 24, beyond the plane 23 of symmetry, has been removed so that all electrons emerge from the magnet 24 perpendicular to the magnet edge 28 and parallel to the central ray. The effective bend angle is therefore one-half of 120° or 60°. Upon emerging from the magnet 24, the electrons are focused on the center of the output cavity 30 by means of a solenoid lens 32. Electron focussing is provided by the solenoid lens 32 since the electrons interact (as described by the Lorentz force law) with the short range static axial and radial magnetic field of the solenoid lens 32. Finite gap corrections modify the input and output edges of the magnet 24 by the same correction angle, up to 4°, given in Table I. The input edge rotation angle v, is 41°. An object distance $L_1$ at 24 cm is used and the bend radius $R_1$ is 20 cm.

The advantage of this alternative embodiment is a shorter, more compact apparatus.

Another alternative to the magnet of FIG. 1 is a magnet with a nonzero field index, n, defined by $B=B_b(r/R)^{-n}$. For example, with n=½ and perpendicular edges (θ=0), the focal length for the case of equal object and image distance, L, and equal median plane/transverse plane focusing, is obtained from $$L/R=[2\ cot\ (\alpha/(2\sqrt{2})) \quad (7)$$

neglecting the fringe field, Harald A. Enge, Chapter "Deflecting Magnets" in "Focusing of Charged Particles" Vol. II, Academic Press, Ed. A. Septier, (1967); Hermann Wollnik, "Optics of Charged Particles," Academic Press (1987).

Table II gives a summary of focal lengths and the resulting path lengths for this magnet as well as the uniform field magnet of FIG. 1.

TABLE II

| | Magnet Comparison | | | | | |
|---|---|---|---|---|---|---|
| | Uniform Magnet | | n = ½ Magnet | | n = ¼ Magnet | |
| α | L/R | S/R | L/R | S/R | L/R | S/R |
| 60° | 3.47 | 7.99 | 3.64 | 8.33 | | |
| 90° | 2.00 | 5.57 | 2.28 | 6.13 | * | 4.5 |
| 120° | 1.16 | 4.40 | 1.55 | 5.19 | | |
| 155° | NA | NA | 1 | 4.71 | | |

*Unequal object and image distance: L/R (input) = 0.917; L/R (output) = 2.0.

Table II indicates that a uniform magnet, with edge focusing, has a slightly shorter path length than the nonuniform magnet, for the cases considered. The second alternative embodiment which uses one-half of a 120° uniform magnet, can have an even shorter path length. The latter case depends on the details of the solenoid strength. We estimate its total path length at 4.2 R, which is slightly less than the 120° magnet and the 90°, n=¼ magnets of Table II. Version 2, which uses an axial magnetic field for beam containment and focusing, is sufficiently different from the above geometries that it is considered separately.

It can be concluded that among the versions of magnet design not involving an axial field, either a 120° magnet or the magnet/solenoid combination are the optimum candidates for practical realization of the invention.

An extensive theoretical investigation has been done on the transverse modulation klystron [(TMK) Y. Seo and P. Sprangle, NRL memorandum report #6756 (1991)] which we summarize below. Basically, the theory indicates that the TMK can achieve the high modulation density necessary for efficient microwave generation. Furthermore, when the current is increased, the electron bunching is deteriorated by the self-field in a conventional klystron, while the self-field enhances the bunching in the TMK. The bunching enhancement is due to the negative mass effect and only occurs in the bend region. In the drift region between the exit of the magnet and the output cavity (FIGS. 1 and 2) a longitudinal plasma oscillation sets an upper bound for the drift length. That is, in order to not deteriorate the modulated density achieved we must satisfy, $L_2 \ll 1/k_5$ where $k_5$ is the plasma wave number and is given by $$k_s = \left(\frac{\omega}{c}\right)\left(\frac{I}{I_o}\right)^{1/2} (\gamma\beta)^{-5/2} \tag{8}$$

and $\omega$=radian rf frequency, I=beam current, $I_o$=17 kA and $\gamma$= relativistic mass factor. We will derive eq. (8) in the next section. Evaluating eq. (8) for I=1A, $f$=1.3 GHz and an energy of 50 kev, then $1/k_5$=66 cm. This result can easily be satisfied for a real device.

The transverse modulation klystron has theoretically been shown to have a high electrical efficiency, high gain, is compact and produces high power at high voltage, limited by space charge effects.

In order to have higher power at a given voltage, we must increase the current. This is not possible in the original version of the TMK since the self-fields expand the beam. By applying a modest axial guide magnetic field, it can be shown that current can be increased by an order of magnitude at the same energy.

Figure 3B:
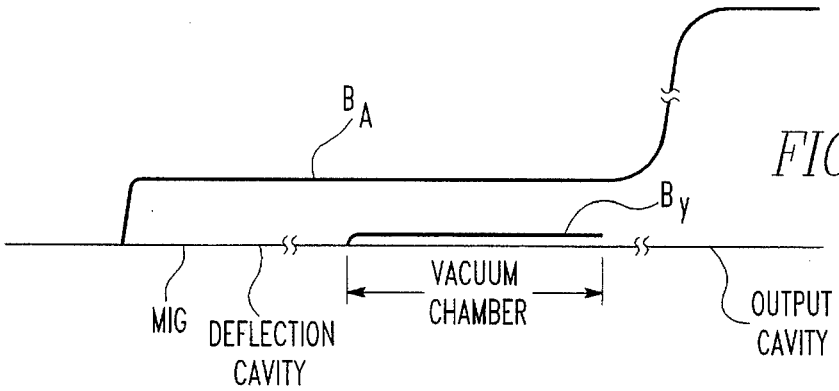
FIG. 3 is another alternative embodiment of the present invention.
Figure 3A:
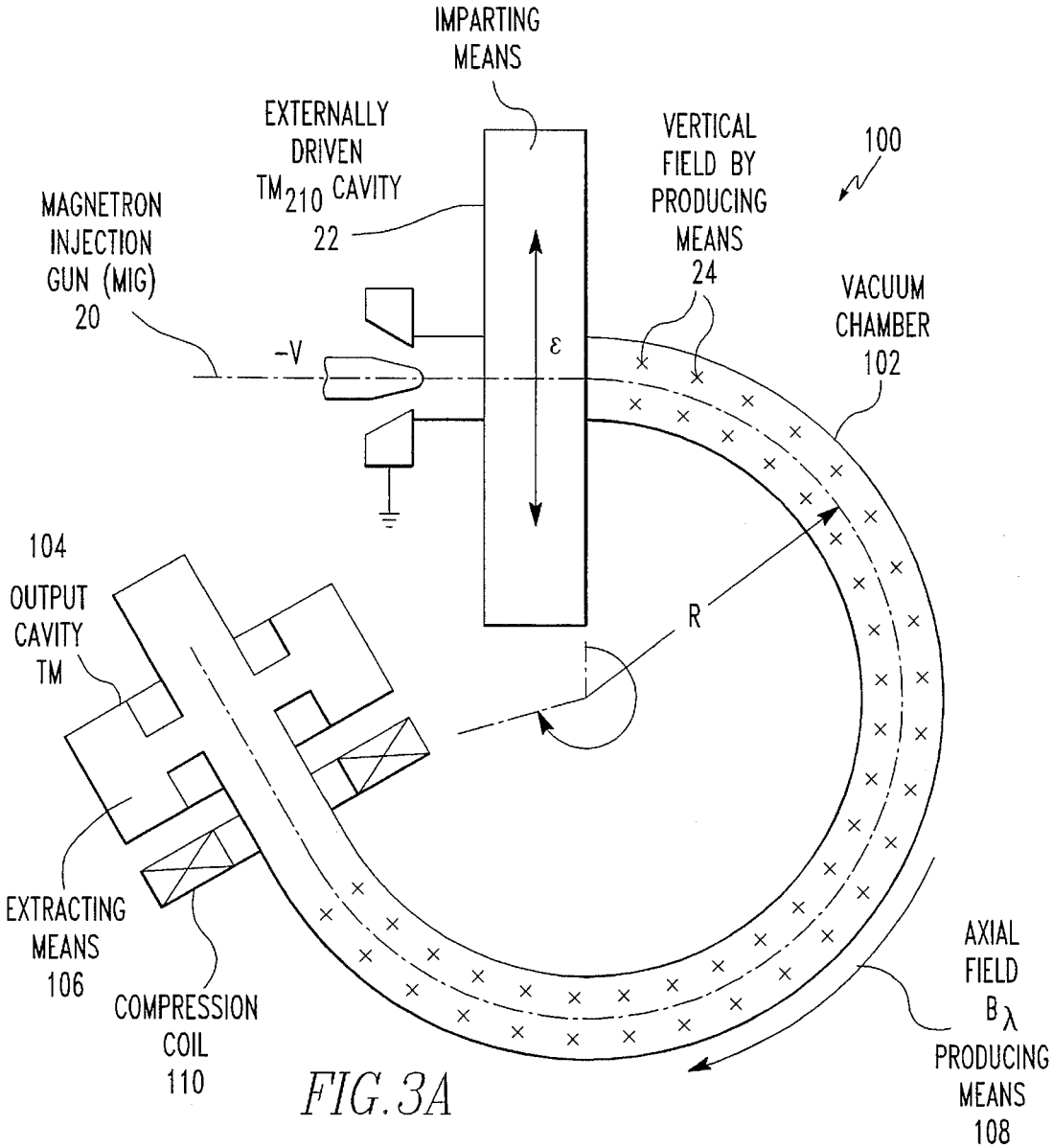

FIG. 3 shows a schematic of the preferred embodiment axial-field TMK. In FIG. 3, there is shown an apparatus 100 for bunching relativistic electrons. The apparatus 100 is comprised of an electron gun 20 for producing a pin beam of electrons. The apparatus 100 is also comprised of a vacuum chamber 102 at least a portion of which is toroidally shaped with major radius R. The vacuum chamber 102 is comprised of an input cavity 22 having means for imparting a predetermined drift displacement to each electron as it passes therethrough such that electrons are caused to bunch together at a predetermined location in the vacuum chamber 102. The imparting means in the input cavity 22 is the rf magnetic field, $B_{rf}$, of the $TM_{210}$ cavity mode. The input cavity 22 is in alignment with the gun 20 to receive electrons therefrom. The vacuum chamber 102 is also comprised of an output cavity 104 disposed at essentially the opposite end of the toroidal portion. The output cavity 104 has means 106 for extracting RF energy from electrons passing therethrough. The upper portion of FIG. 3 shows the relative strength of the axial ($B_A$) and vertical ($B_Y$) magnetic fields as a function of the axial position. Also, the relative positions of each component are shown with respect to the field. Axial refers to the direction along the beam path while vertical refers to a direction transverse to the beam path. The apparatus 100 is also comprised of means for producing an axial magnetic field $B_A$ (the profile is shown in the upper portion of FIG. 3) and at least a toroidal portion of the vacuum chamber 102 to maintain the electrons in the chamber. The axial magnetic field producing means is in electromagnetic communication with the vacuum chamber 102. The apparatus 100 is also comprised of means for producing a vertical magnetic field $B_y$ 24 (the profile is shown in the upper portion of FIG. 3) in the vacuum chamber 102 to maintain the electrons in the chamber 102. The vertical field producing means is in electromagnetic communication with the vacuum chamber 102.

Preferably, as shown in the top portion of FIG. 3, the axial magnetic field, $B_A$, is constant along the entire beam trajectory and increases by means of the compression coil 110 in the output cavity.

In FIG. 3, a small diameter beam is produced by a magnetron injection gun (MIG) 20, proposed for the higher voltage cases which was analyzed [R. Palmer, W. Hermannsfeldt and K. Eppley, SLAC-PUB-5026]. For lower voltage, a conventional Pierce gun is proposed where the magnetic field is zero at the cathode and increases up to a constant value. The beam travels into an input cavity which operates in a $TM_{210}$ mode and has a transverse rf magnetic field in the plane of the figure. Note that the magnetic field $B_{rf}$ is rotated by 90 degrees from the basic concept in FIG. 1. The modulated beam just after it enters the bend region begins to bunch by the transit time difference the same as in the non-axial-field TMK. The bunched beam is compressed (by means of a compression coil) just prior to entering the output cavity. Compression is required for high rf extraction efficiency. The output cavity is the same as in the non-axial-field version of the TMK.

Figure 4A:
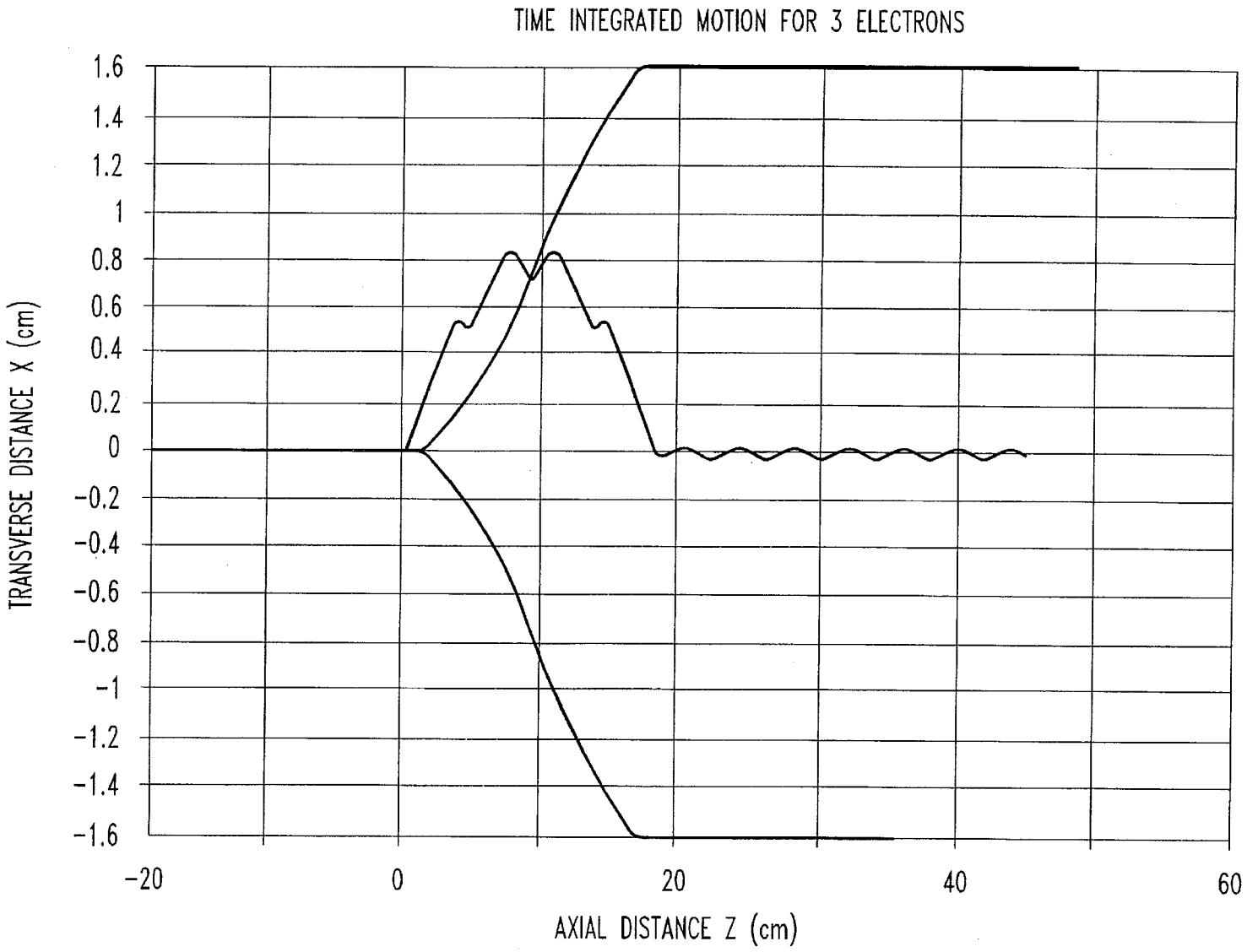
FIG. 4*a* is a graph of the drift deflection in a TM210 cavity.
Figure 4B:
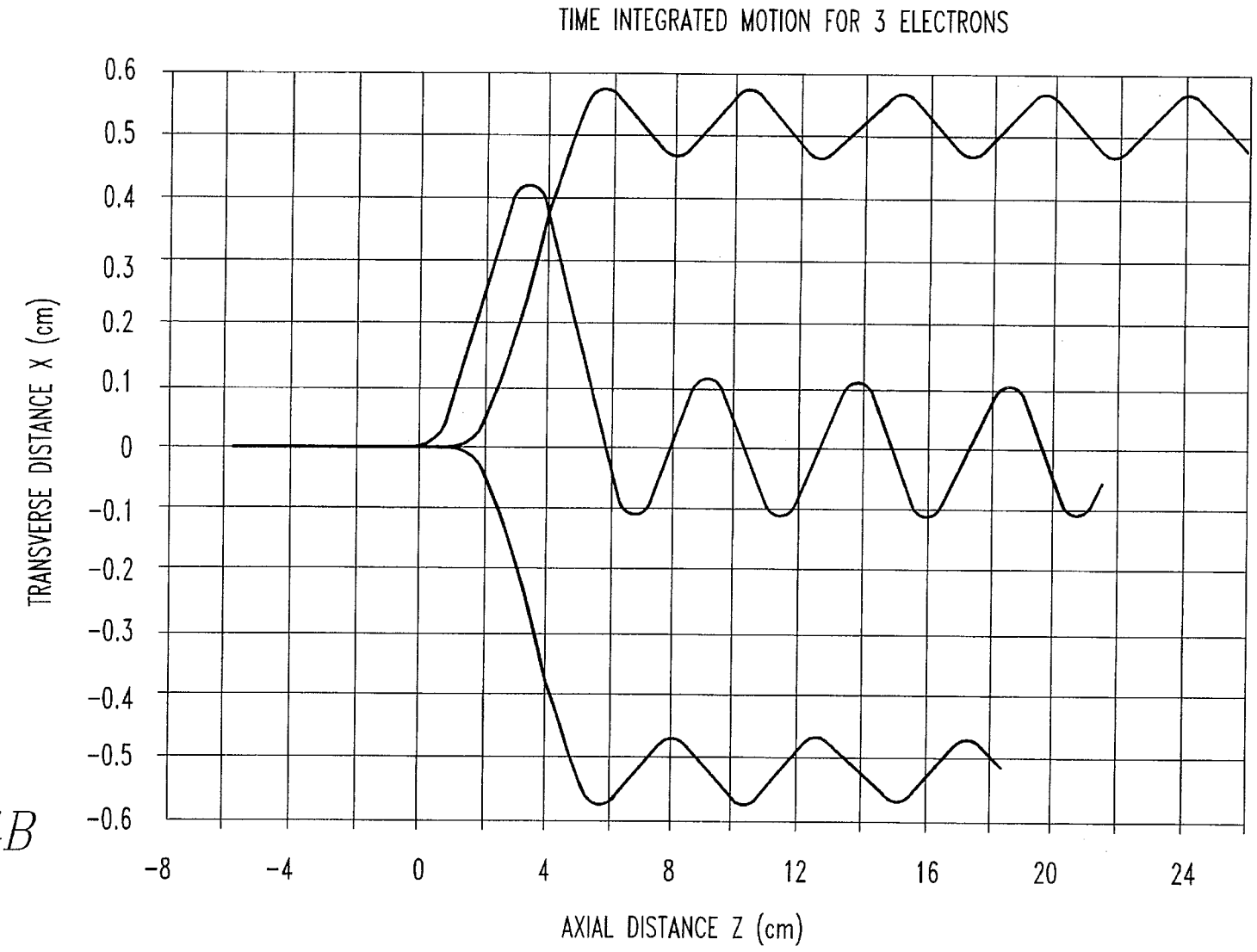
FIG. 4*b* is a graph of the drift deflection in a TM210 cavity in a different environment that FIG. 4*a*.

In order to accomplish modulation from the input cavity 22 (still in the plane of the figure), the incoming beam is allowed to drift using the $FxB_A$ mechanism, where $F=-ev_2B_{rf}$, $v_z$=axial velocity and $B_{rf}$=rf magnetic field. FIGS. 4*a* and 4*b* show two examples of the drift modulation method. In each example, three electrons are injected into a $TM_{210}$ mode cavity where the cavity length is half the rf period times the particle velocity. The cavity begins at z=0 and extends to the length $L_c=B_z\lambda/2$. The particles are injected at a phase such that the maximum, minimum and no deflection occurs. The resulting time integrated trajectories are shown. The parameters for FIG. 4*a* are $f$=0.5 GHz, $B_A$=2 Kg, $B_{rf}$=0.28 Kg, $\beta_z$=0.6. For FIG. 4*b* the parameters are $f$=1.3 GHz, $B_A$=1.5 Kg, $B_{rf}$=0.194 Kg, $\beta_z$=0.548. FIG. 4*b* shows an oscillation on the trajectory; this is simply the resulting cyclotron motion of the particle. this motion represents a small fraction of the total particle energy. The axial field relaxes the space charge problem but makes the beam deflection more difficult than without it. In order to accomplish deflection a larger rf field is required which in turn requires more rf power, thus reducing the gain. We propose a solution to the gain problem by adding an intermediate cavity. This is described in later sections.

The drift deflection and Larmor radius for the $TM_{210}$ mode have been derived. For this mode the dominant field near the axis is a constant magnetic field, given by $B_x=B_{rf}$ sin( wt), where the x direction is perpendicular to the beam and in the plane of FIG. 3.

The equations of motion are:

$$v_x v_y \Omega_z \tag{9}$$

$$v_y = -v_x\Omega_z + v_z\Omega_x \tag{10}$$

where $$\Omega_z = \frac{eB_A}{\gamma m}, \Omega_x = \frac{eB_x}{\gamma m}.$$

Assuming $\gamma$ and $v_z$ are constant, equations (9) and (10) can be solved to give $$\upsilon_y = \frac{\upsilon_z\Omega_{rf}\omega}{\Omega_z^2 - \omega^2}\,[\cos(\omega t) - \cos(\Omega_z t)] \tag{11}$$

$$\upsilon_x = \frac{\upsilon_z\Omega_{rf}}{\Omega_z^2 - \omega^2}\,[\Omega_z\sin(\omega t) - \omega\sin(\Omega_z t)] \tag{12}$$

where

-continued $$\Omega_{rf}=\frac{eB_{rf}}{\gamma m}.$$

The maximum drift displacement ($\Delta R$) at $t=\pi/\omega$ and Larmor radius ($r_L$) can be derived from equations (11) and (12) to give, $$\Delta R=-2v_z\Omega_{rf}/(\omega\Omega_z) \tag{13}$$

and $$r_L=\Delta R\cos\left(\frac{\pi\Omega_z}{2\omega}\right)/[(\Omega_z/\omega)^2-1] \tag{14}$$

After evaluating equations (13) and (14) for parameters of interest, it has been found that enough deflection can be achieved while keeping the transverse energy small. For example at $f$=1 GHz, $B_A$=1 kG, $B_{rf}$=0.278 kG, $\beta_z$=0.6 a deflection of 1.6 cm can be achieved while the transverse energy is about 8% of the axial energy. At $f$=0.5 GHz, and all other parameters the same, the deflection is 3.18 cm and the transverse to axial energy is about 0.9%. For the modulated beam to bunch in the bend we require that the transit time difference between the non-deflected particle trajectory and the maximum deflected particle trajectory to be equal to one-quarter of the rf period, that is:

$$\Delta R=\frac{\beta_z c}{2\omega N}\text{, where } N \text{ is the number} \tag{15}$$

of 180° bend angles. For example, if N=1 then a 180° bend is needed or if N=1.5 then a 270° bend is required.

The optimum bend angle turns out to be about 257°. Angles much less than 257° require more rf power and drive the displacement into a non-linear region. For angles larger than 257°, a very small beam radius is required which is not possible to achieve with existing electron guns.

In order to have most of the beam participate in the modulation process, we require the beam radius ($r_b$) to be small compared to the drift deflection, $$\Delta R=\mu r_b\text{, where } \mu \text{ is a number} \tag{16}$$

that will be picked such that the beam size will be smaller than the deflection.

Two limits are calculated on the beam current. The first is the limit that space charge imposes on transport in a magnetic field and the second limit is on bunching.

In the absence of emittance, the maximum current that can be transported can be calculated from the envelope equation to be, $$I=\frac{I_o\beta_z\gamma^3}{8}\left(\frac{r_b}{c}\right)^2\Omega_z^2. \tag{17}$$

Next, it is calculated how the current places a limit on the distance over which bunching can occur.

Consider an electron beam traveling down a perfectly conducting pipe where the beam nearly fills the pipe diameter. The electric and magnetic field are as follows:

$$E_p=\frac{-|e|\,n_t}{2\epsilon_o}\left(\frac{r_b}{\rho_c}\right)^2\rho\text{, where } n_t \text{ is the beam density,} \tag{18}$$

and $\rho_c$=pipe radius.

The factor $(r_b/\rho_c)^2$ corrects for the beam changing its radius after it has been modulated and bunched.

$$B_\theta=\frac{\mu_o J}{2}\left(\frac{r_b}{\rho_c}\right)^2\rho\text{, where } J=\text{current density} \tag{19}$$

and $\mu_o$ is the permeability of free space.

From an axial displacement of charge given by $$\beta(z)=A\cos(\omega t-kz)$$

the principal density perturbation can be calculated from Fourier analysis and is given by $$\delta n=n_o kA\sin(\omega t-kz)\text{, where } k=\frac{\omega}{v_z} \tag{20}$$

and A is a displacement amplitude factor and $n_o=n_t-\beta n$. A detailed derivation of Eq. (20) can be found in Ref Y. Seo and P. Sprangle, NRL memorandum report #6756 (1991).

The axial electric field can be found from $$E_z=\frac{\partial}{\partial z}\int_o^{\rho_c}E_\rho d\rho+\frac{\partial}{\partial t}\int_o^{\rho_c}B_\theta d\rho. \tag{21}$$

From equations (18)–(21) it can be calculated the final form for the axial electric field.

$$E_z=\frac{m}{e}\left(\frac{I}{I_o}\right)\frac{1}{\beta_z^3}\left(\frac{\omega}{\gamma}\right)^2 A\cos(\omega t-kz) \tag{22}$$

which can be written $$E_z=\frac{m}{e}\left(\frac{I}{I_o}\right)\left(\frac{\omega}{\gamma}\right)^2\frac{\delta(z)}{\beta_z^3} \tag{23}$$

Now form a right handed coordinate system (r, z, y) where r is an outward radial coordinate in the plane of the paper, i.e., it is perpendicular to the centerline in FIGS. 1 or 3, y is into the paper, and z is along the centerline.

The additional magnetic fields introduced by a bending magnet having a field index, n is considered:

$$B_r=B_{oy}n\frac{z}{R} \tag{24}$$

$$B_y=B_{oy}(1-(nr/R)) \tag{25}$$

$$B_z=B_A \tag{26}$$

where $$n=-(R/B_{oy})\,[\partial B_y/\partial r]_{r=o}=\text{external field index}$$

A change of variables is used (from time t to axial position z using the transformation $d/dt=v_2 d/dz$) and assume small perturbations from the equilibrium are valid. Then $r=\partial r$, $y=\partial y$ and $z=z_0+\partial z$. The equations of motion including equations (23)–(26) then become $$\delta r''+k_r^2\delta r=k_z\delta y' \tag{27}$$

$$\delta y''+k_y^2\delta y=-k_z\delta r' \tag{28}$$

$$\delta z''+k_s^2\delta z=\frac{-\delta r'}{R}\text{, where} \tag{29}$$

$$k_r^2=(1-n)/R^2,\ k_y^2=n/R,\ k_z=B_A/(RB_{oy})$$

and $k_5$ is from eq. (8).

Equations (27)–(29) are time averaged over the axial field frequency, which gives the guiding center equations $$r_c'' - \left(\frac{k_y}{k_z}\right)^2 k_1^2 r_c = \left(\frac{k_y}{k_z}\right)^2 k_2 \delta z_c' \quad (30)$$

$$z_c'' + k_s^2 z_c = \frac{-r_c'}{R} \quad (31)$$

where $$k_1^2 = (y^2 - (1-n)/R^2 \quad (31)$$

and $$k_2 = y^2/R.$$

The most interesting approximate solution is $$z_c(z) \cong \frac{1}{k_s}\left(\frac{\Delta R}{R}\right)\sin k_s(z - L_l). \quad (32)$$

Equation (32) gives an optimum path length $L_0$. Equation (32) also shows no negative mass instability which is consistent with reference [P. Sprangle and J Vomvoridis, 16 Part. Accel. 18., 1 (1985)]. $L_0$ is determined from the beginning of bunching to the output cavity, i.e., $$L_o = \frac{\pi}{2k_s} \quad (33)$$

Equation (33) limits the bunching length, hence the radius of the device ($L_0$=RN$\pi$) to $$R = \left(\frac{c}{2N\omega}\right)(\gamma\beta_z)^{5/2}\left(\frac{I_o}{I}\right)^{1/2}. \quad (34)$$

The cavity losses and fill time can be obtained from standard texts such as reference [S. Ramo, J. R. Whinnery and T. Van Duzer, "Fields and Waves in Communication Electronics," Wiley Z. Sous (1965)]. These relationships are written for completeness. The power loss to the input cavity in the $TM_{210}$ mode is $$P_i = \frac{R_s}{8}\left(\frac{\lambda c}{Z_o} B_{rf}\right)^2 \left[\frac{3L_c}{\alpha} + 2\right] \quad (35)$$

where $$R_s = \text{surface resistivity}, Z_o = \sqrt{\frac{\mu_o}{\epsilon_o}}$$

and a is the cavity height. The cavity width is assumed to be **2*a***.

The fill time is given by $$\tau = \frac{2Q}{\omega}, \text{ where the } Q \text{ must be} \quad (36)$$

evaluated first for the $TM_{210}$ mode. The electrical efficiency is defined by $$\eta_e = \frac{\eta_{rf} P_{beam}}{(P_i/\eta_i) + P_{beam}} \quad (37)$$

where $P_{beam}$ is the electron beam power, $\eta_{rf}$ is the conversion efficiency from beam to rf power, $P_t$ is the rf power into the input cavity, and $\eta_t$ is the electrical efficiency for the input cavity rf source. It has been demonstrated with particle pushing codes that the intrinsic conversion efficiency $\eta_{rf}$ is 50 to 60%. It will be assumed that $\eta_{rf}$ is 50%. Also, it is assumed that $\eta_t$=50%.

Equations (13)–(17), (34)–(37), are the governing equations to evaluate the performance of this device. Table III shows the parameters used in the evaluation and Table IV shows the results for two different cases of wall material in the input cavity. Each column represents the corresponding results for a given electron energy at the top of the column. There are several columns, with each column at a different electron energy. The first case is for 304 Stainless Steel (72 μΩ–cm) and the second is for copper (1.8 μΩ–cm). The output power is acceptable. However, the gain is low at low voltages (∠/~100 kV). It is possible to improve the gain somewhat by using a different input cavity mode.

TABLE III

Parameters Used for Calculations

| | | | | | |
|---|---|---|---|---|---|
| Energy (keV) | 50 | 100 | 200 | 500 | 1000 |
| Current (A) | 10.8 | 32.6 | 104.8 | 575.6 | 2493.0 |
| Micro-Perveance | 0.96 | 1.03 | 1.17 | 1.63 | 2.49 |
| Beam Rad. (cm) | 0.177 | 0.235 | 0.298 | 0.370 | 0.403 |
| Pipe Rad. (cm) | 1.24 | 1.64 | 2.09 | 2.59 | 2.82 |
| Bend Rad. (cm) | 7.1 | 10.2 | 15.1 | 26.6 | 43.4 |
| Axial Field (G) | 1019 | 1110 | 1291 | 1836 | 2745 |
| RF Field (G)* | 178 | 194 | 226 | 321 | 480 |

*Peak rf magnetic field in the input cavity for 2-cavity model. In all cases, freq. = 1300 MHz, generalized perveance = 0.0136, bend angle = 257 degrees, deflection = 3x beam radium, and output cavity efficiency = 50%.

TABLE IV

TM-210 Deflection Cavity

| | | | | | |
|---|---|---|---|---|---|
| Stainless Steel | | | | | |
| Energy (keV) | 50 | 100 | 200 | 500 | 1000 |
| Fill Time (usec) | 0.68 | 0.83 | 0.95 | 1.07 | 1.12 |
| Power In (W) | 2.34E+05 | 3.06E+05 | 4.55E+05 | 1.01E+06 | 2.36E+06 |
| Power Out (W) | 2.69E+05 | 1.63E+06 | 1.05E+07 | 1.44E+08 | 1.25E+09 |
| Gain | 1.1 | 5.3 | 23.0 | 142.0 | 527.6 |
| Efficiency | 0.267 | 0.421 | 0.479 | 0.497 | 0.499 |
| Copper | | | | | |
| Energy (keV) | 50 | 100 | 200 | 500 | 1000 |
| Fill Time (usec) | 4.31 | 5.20 | 6.00 | 6.76 | 7.07 |
| Power In (W) | 3.73E+04 | 4.86E+04 | 7.23E+04 | 1.61E+05 | 3.76E+05 |
| Power Out (W) | 2.69E+05 | 1.63E+06 | 1.05E+07 | 1.44E+08 | 1.25E+09 |
| Gain | 7 | 34 | 145 | 893 | 3319 |
| Efficiency | 0.439 | 0.486 | 0.497 | 0.499 | 0.500 |

Figure 5:
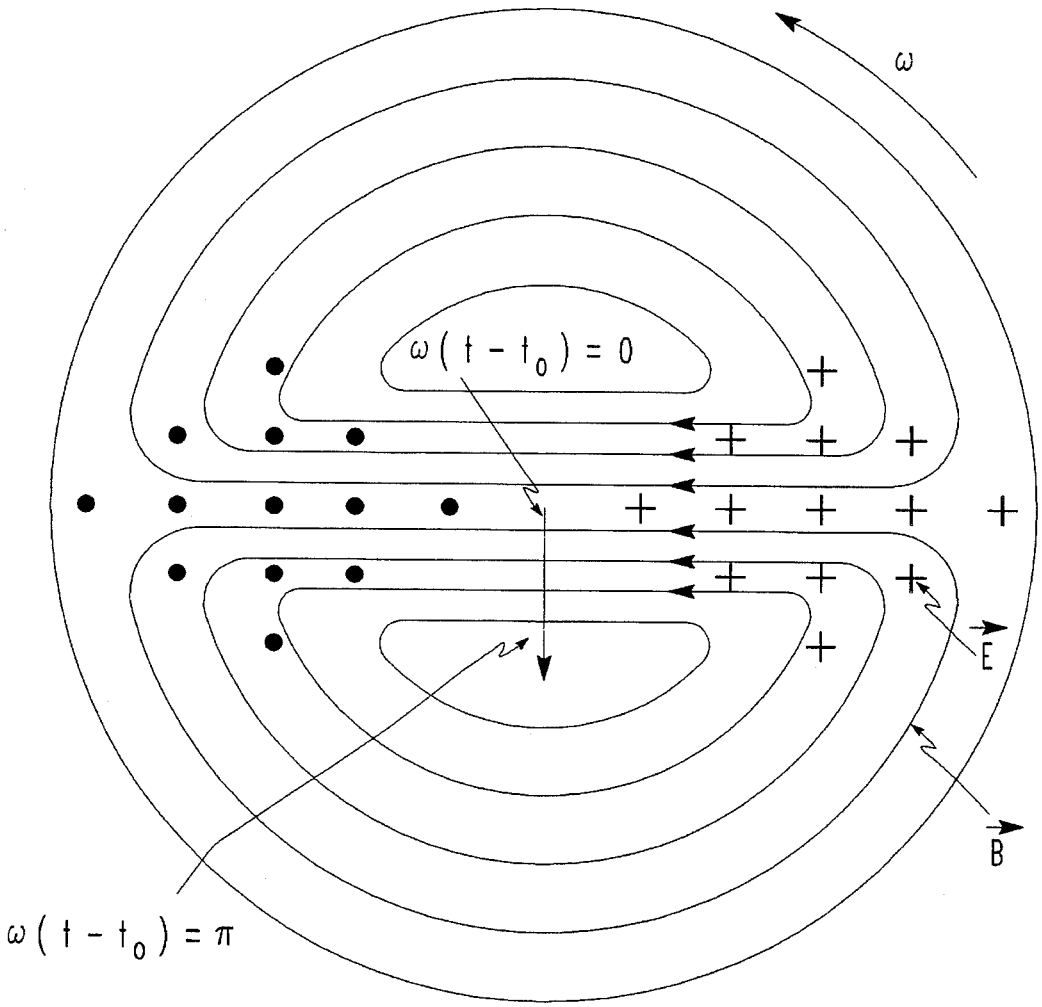
FIG. 5 is a schematic representation of the field pattern in a cylindrical TM110 cavity.

An alternative cavity mode to consider is the $TM_{110}$ rotating mode in a cylindrical cavity, shown in FIG. 5. The electric field points in (+ pluses) and out (• solid dots) of the page. The magnetic field is represented by the solid lines. The heavy short line represents the electron beam displacement after a rotation angle of $\pi$. Finally, the whole field pattern rotates at $\omega$. In FIG. 3, the $TM_{210}$ cavity is replaced with a $TM_{110}$ cavity. The first advantage with this change is that the $TM_{110}$ cavity is smaller thus allowing for lower cavity losses which improves the gain.

Consider cylindrical ($\rho$, $\theta$, z) and cartesian (x, y, z) coordinate systems located at the center and base of a cylindrical cavity (y is now out of the page). The exact electromagnetic fields for the $TM_{110}$ mode are given in cartesian component form by, $$B_x = 2B_{rf}\left[\frac{J_1(\eta\rho)}{\eta\rho}\cos(\omega t) - J_2(\eta\rho)\sin(\theta-\omega t)\sin\theta\right] \tag{38}$$

$$B_y = 2B_{rf}\left[\frac{J_1(\eta\rho)}{\eta\rho}\sin(\omega t) + J_2(\eta\rho)\sin(\theta-\omega t)\cos\theta\right] \tag{39}$$

where $J_1(\nu\rho)$ and $J_2(\nu\rho)$ are Bessel functions and $\nu=\omega/c$. Near the axis Equations (38)–(40) reduce to $$B_x = B_{rf}\cos(\omega t) \tag{41}$$

$$B_y = B_{rf}\sin(\omega t) \tag{42}$$

$$E_z = B_{rf}\omega[x\cos(\omega t) + y\sin(\omega t)] \tag{43}$$

For the analytical analysis, the effects of the $E_z$ field are ignored but are included later in a particle pushing code. Both y and $v_z$ are assured to be constant. The equations of motion for the beam centroid or a particle are:

$$\dot{v}_x = -v_y\Omega_z + v_z\Omega_{rf}\sin(\omega t). \tag{44}$$

$$\dot{v}_y = -v_z\Omega_{rf}\cos(\omega t) + v_x\Omega_{rf}. \tag{45}$$

With the definitions $v_t = v_x + i\,v_y$ and $\zeta_t = x + iy$ where $i=\sqrt{-1}$, the solution of Equations (44)–(45) are:

$$\upsilon_t = \frac{-\upsilon_z\Omega_{rf}}{\Omega_z-\omega}\,e^{i\omega t}\left[e^{i(\Omega_z-\omega)(t-t_o)} - 1\right] \tag{46}$$

$$\zeta_t = \frac{\upsilon_z}{(\Omega_z-\omega)}\left(\frac{\Omega_{rf}}{\omega}\right)e^{i(\omega t-\frac{\pi}{2})}\times \left[1 - \frac{\omega}{\Omega_z}\,e^{i(\Omega_z-\omega)(t-t_o)} - \left(1-\frac{\omega}{\Omega_z}\right)e^{-i\omega(t-t_o)}\right] \tag{47}$$

where the initial conditions for a particle entering at $t=t_o$ are $\zeta_t = v_t = 0$.

In order for the particle or beam centroid orbit to follow the phase of the electromagnetic mode, the imaginary terms inside the brackets in Eq. (47) are required to vanish, i.e., $$\sin[(\Omega_z-\omega)(t-t_o)] - \left(\frac{\Omega_z}{\omega} - 1\right)\sin\omega(t-t_o) = 0 \tag{48}$$

For Eq. (48) to be satisfied it is necessary that $$\Omega_z = 2\omega. \tag{49}$$

Although it appears that Eq. (48) is satisfied by letting $\Omega_z=\omega$, this is not true when the denominator of Eq. (47) is taken into account.

The factor of two in Eq. (49) may not be immediately transparent. Note that $\Omega_z$ is the frequency about the orbit axis. If the Larmor frequency had been used which is twice the cyclotron frequency ($\Omega_z$) then the factor of two would disappear. As the mode rotates, the particle rotates with the mode and always is at a position where the electric field $E_z=0$.

Using Eq. (49) in Equations (46) and (47) results in the following expressions:

$$\upsilon_t = -\upsilon_z\left(\frac{\Omega_{rf}}{\omega}\right)e^{i\omega t}\left[e^{i\omega(t-t_o)} - 1\right] \tag{50}$$

$$\zeta_t = \frac{2\upsilon_z\Omega_{rf}}{\omega^2}\sin^2\frac{\omega}{2}(t-t_o)\,e^{i(\omega t-\pi/2)} \tag{51}$$

Maximum deflection occurs when the interaction angle $$\upsilon_{tm} = -2\upsilon_z\left(\frac{\Omega_{rf}}{\omega}\right)e^{i\omega t_o}$$

Then $$\zeta_{tm} = i2\frac{\upsilon_z\Omega_{rf}}{\omega^2}\,e^{i\omega t_o} \tag{53}$$

Figure 6:
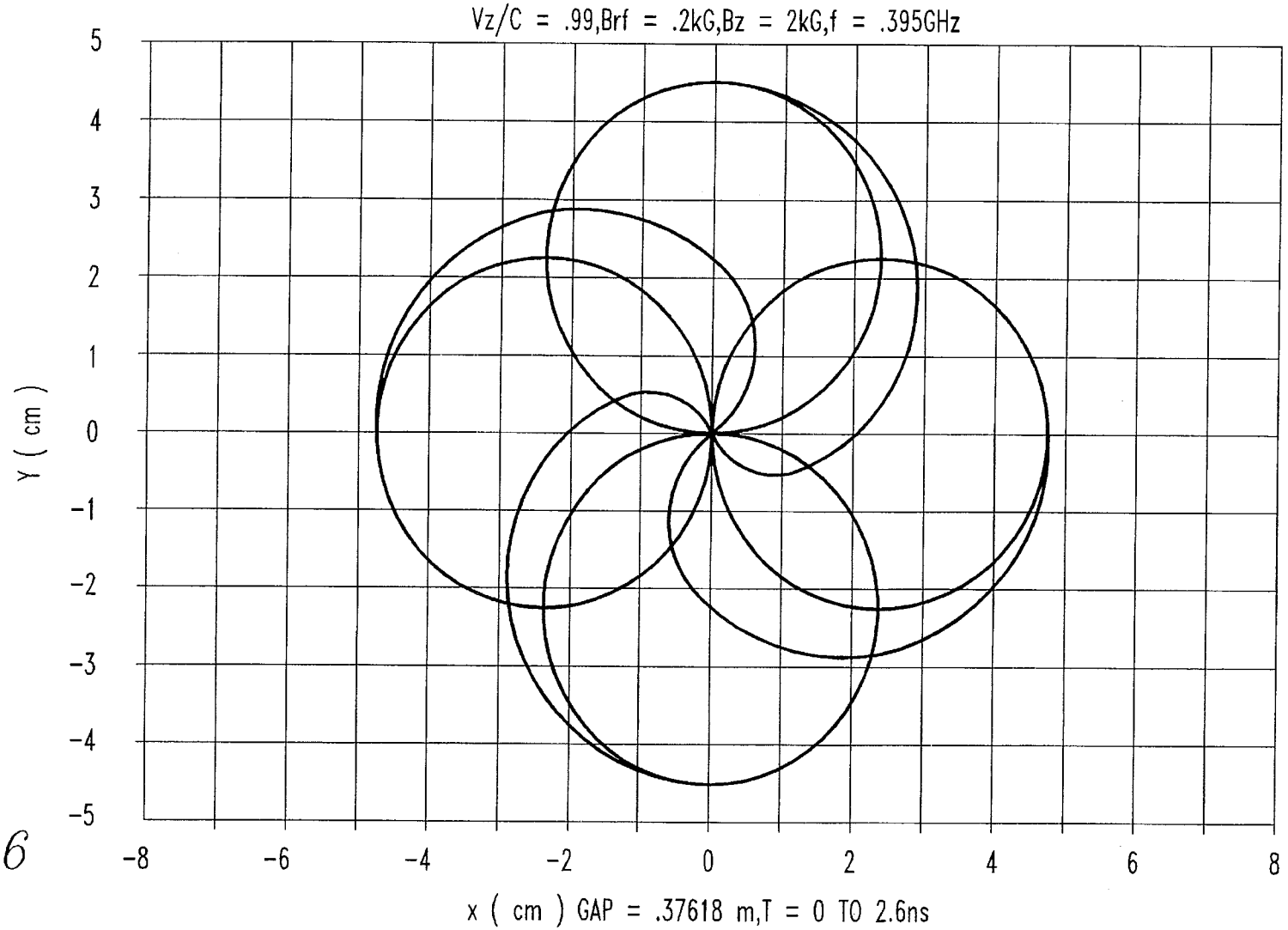
FIG. 6 is a graph of the particle response to TM110 cavity mode for an idealized particle drift motion.

As the particle entrance time $t_o$ changes, the orbit centroid rotates about the z-axis. When the particle leaves the cavity it is left rotating about its center displacement. FIG. 6 shows the results for four particles entering the cavity at $\omega t_o = 0, \pi, 3\pi/2$ and leaving the cavity at maximum displacement. After passing through the cavity the particle or beam centroid is left gyrating and drifting about the axial field. These results were calculated with a relativistic 3D particle pusher which uses the fields from Equations (41)–(43). The parameters were $\beta_z=0.99$, $B_{rf}=0.2$ kG, $B_z=2$ kG, f=0.395 GHz.

The displacement of the orbit center can be calculated to $$\Delta R = \frac{\upsilon_z\Omega_{rf}}{\omega^2} = \left(\frac{\upsilon_z}{\Omega_z}\right)\left[4\frac{\Omega_{rf}}{\Omega_z}\right] \tag{54}$$

This is the same displacement as given by Eq. (13) for the $TM_{210}$ mode when $\Omega_z=2\omega$ is taken into account. Thus this mode does not improve the displacement if $B_{rf}$ is provided by an external rf source.

The quantity in brackets in Eq. (54) is selected for our performance evaluation to be a value of 0.7. The reason for this selection is to avoid non-linear effects as discussed later.

The rf power lost to the input cavity walls for the $TM_{110}$ mode is given by $$P_i = \frac{R_s}{8}\left(\frac{\lambda c}{Z_o}B_{rf}\right)^2\left[\frac{2L_o}{\alpha} + 1\right]. \tag{55}$$

Equation (55) is the power lost to a square $TM_{110}$ cavity which will be used for the evaluation of the power lost. The Q and fill time for the $TM_{110}$ square cavity will also be used.

Equations (15)–(17), (34), (49), (54) and (55) are now used to evaluate the performance of this device.

The input parameters are again in Table III and the results in Table V. Each column represents the corresponding results for a given electron energy at the top of the column. There are several columns, with each column at a different electron energy. The output power is very acceptable. The gain has improved by about a factor of two over the TM210 mode case considered. Above 200 kV the gain is very respectable. Using a modest guide field has increased the power output capability by at least a factor of ten as compared to the case without a guide field.

TABLE V

| TM-110 Deflection Cavity | | | | | |
|---|---|---|---|---|---|
| Stainless Steel | | | | | |
| Energy (keV) | 50 | 100 | 200 | 500 | 1000 |
| Fill Time (usec) | 0.62 | 0.74 | 0.84 | 0.93 | 0.96 |
| Power In (W) | 1.29E+05 | 1.72E+05 | 2.60E+05 | 5.88E+05 | 1.38E+06 |
| Power Out (W) | 2.69E+05 | 1.63E+06 | 1.05E+07 | 1.44E+08 | 1.25E+09 |
| Gain | 2.1 | 9.5 | 40.4 | 244.9 | 904.6 |
| Efficiency | 0.338 | 0.452 | 0.488 | 0.498 | 0.499 |
| Copper | | | | | |
| Energy (keV) | 50 | 100 | 200 | 500 | 1000 |
| Fill Time (usec) | 3.91 | 4.63 | 5.26 | 5.83 | 6.06 |
| Power In (W) | 2.05E+04 | 2.73E+04 | 4.13E+04 | 9.34E+04 | 2.19E+05 |
| Power Out (W) | 2.69E+05 | 1.63E+06 | 1.05E+07 | 1.44E+08 | 1.25E+09 |
| Gain | 13 | 60 | 254 | 1540 | 5690 |
| Efficiency | 0.465 | 0.492 | 0.498 | 0.500 | 0.500 |

In solving Equations (44)–(45), it is assumed the axial velocity $v_z$ to be a constant. This approximation is not valid for a large ratio of $\Omega_{rf}/\Omega_z$. As $\Omega_{rf}$ increases in Equations (44)–(45), $v_z$ decreases such that the product $\Omega_{rf}v_z$ saturates at some value of $\Omega_{rf}$. When $v_z$ decreases it increases the interaction time in the cavity. Then the maximum velocity obtained in Equation (52) for an interaction time of $\pi/\omega(t_o=0)$ will be reduced and of course the position that the particle leaves the cavity will be changed.

Figure 7A:
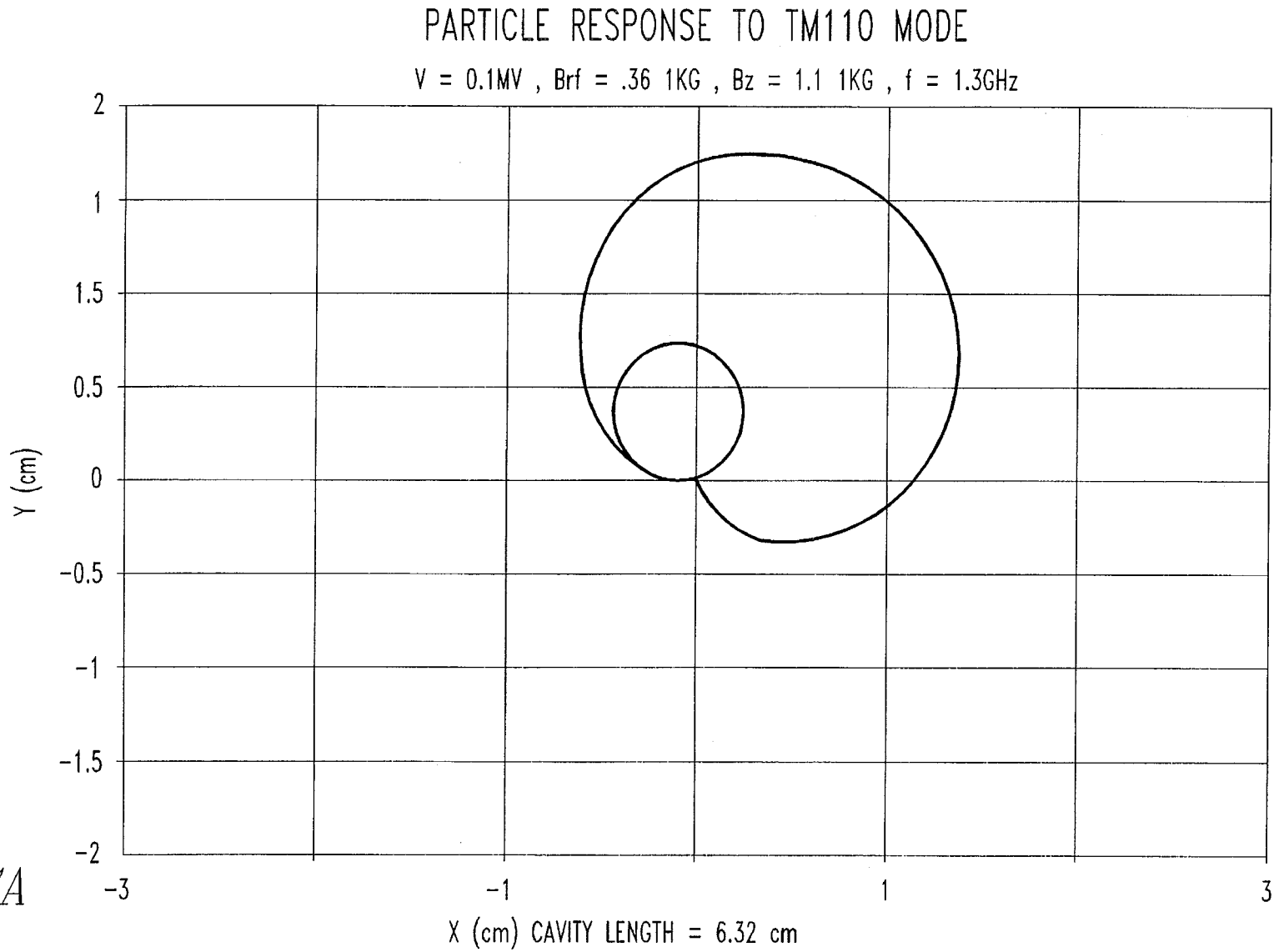
FIG. 7*a* is a graph of a particle response to TM110 mode for a nonideal particle drift motion.

This effect can be substantially compensated for by simply shortening the length of the cavity, thus reducing the interaction time. FIG. 7*a* shows the particle response to the rf field when $\Omega_{rf}\Omega_z$=33%. The interaction time is $\pi/\omega$. As can be seen when the particle leaves the cavity and enters the drift space (circular orbit) there is very little displacement of the guiding center.

Figure 7B:
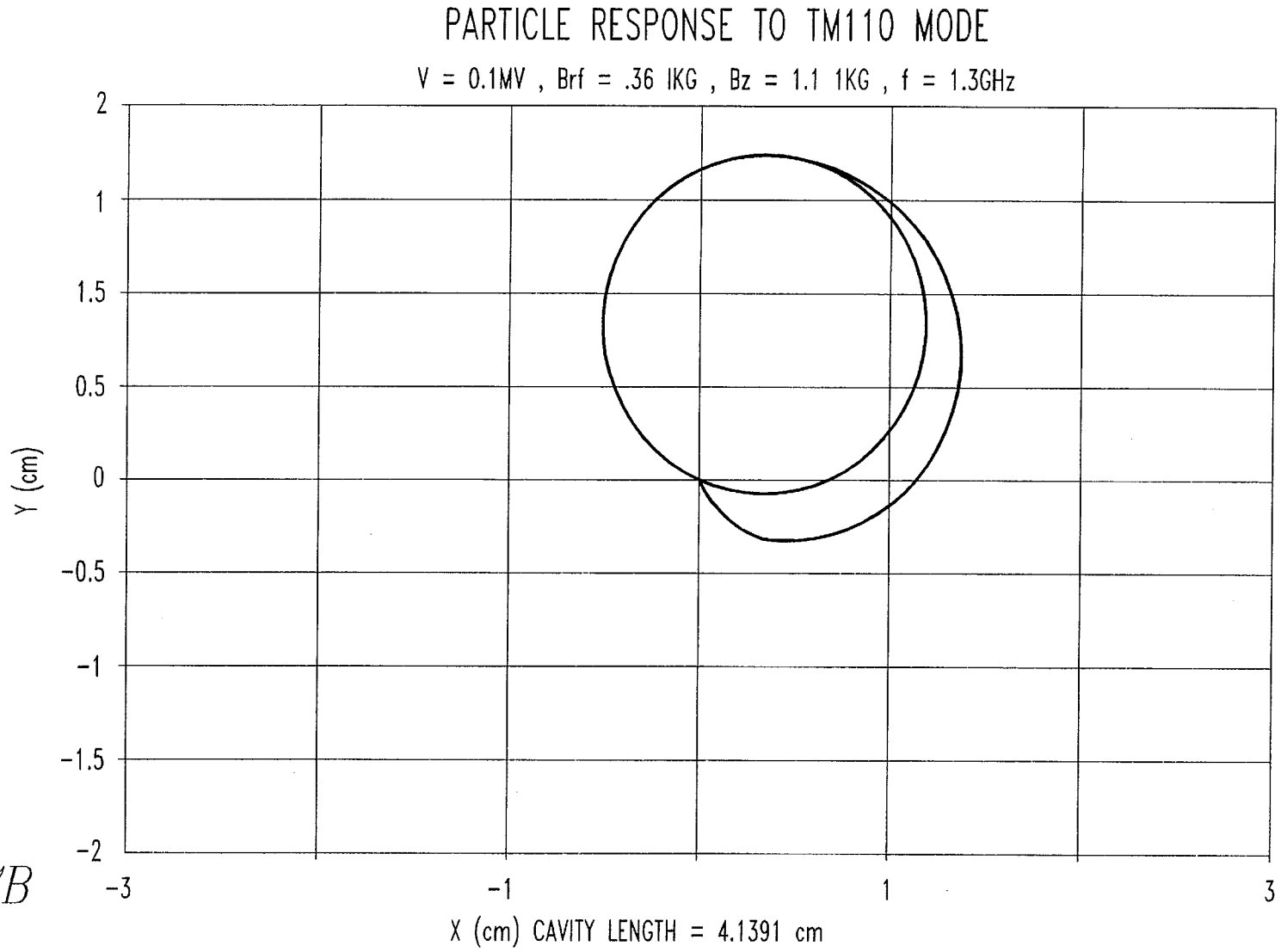
FIG. 7*b* is a graph of the particle response to TM110 mode for nonideal drift.

If the interaction length is reduced by 35%, all else being the same, it can be seen from FIG. 7*b* that there is a 250% increase in the guiding center displacement. These results were produced using a 3D relativistic particle pushing code that includes all of the rf field components.

In the operation of the invention, a collimated beam 20 of electrons traverses input cavity 22 as shown in FIG. 1. The input cavity 22 has present therein a transverse periodic magnetic field e with respect to the direction of the electron beam 20 traversing the input cavity 22. The periodic transverse magnetic field is, for instance, sinusoidal. Isolating a period of $2\pi$ of the periodic transverse magnetic field, initially the transverse magnetic field is at its greatest positive strength causing the electron entering input cavity 22 being imparted with the greatest transverse force. This electron continues through the input cavity 22 since it maintains its momentum with respect to the axial or second direction of the input cavity 22. The next electron that enters the input cavity 22 immediately after the previous electron experiences a transverse magnetic field that is slightly less than the electron before it that is passing through the input cavity 22. This slightly decreasing transverse magnetic field is experienced by subsequent electrons for a period of $2\pi$ resulting in each subsequent electron through the period having respectively less transverse force implied to them. Consequently, as each electron leaves the input cavity 22 traveling to the bending magnet 24 they vary in their transverse momentum corresponding to the transverse force applied to it. The electron that has the most transverse force imparted to it enters the bending magnet the highest distance from the axis of bending magnet 24. The next electron which has a slightly less transverse magnetic force imparted to it, enters the bending magnet 24 at a slightly lower height from the axis of the bending magnet, and so forth, until the electron enters the bending magnet 24 at the lowest position relative to the axis of the bending magnet 24.

Since the path length that the electron must follow is longer, the greater the height of the electron which enters the bending magnet 24, accordingly, the electrons with the most negative transverse momentum to them follow the shortest path length. This results in the electrons passing through the input cavity 22 during the phase from 0 to $\pi$ of the periodic transverse magnetic field essentially leaving the bending magnet 24 at the same time. The electrons that leave the bending magnet 24 approximately the same time are then focused [T. F. Godlove and W. L. Bendel, Rev. Sci. Inst. 36, 909 (1965)] and provided to the output cavity where microwaves are produced from the bunched electrons as well known in the art [D. Reid, Proc. 1988 Linac Conf., 514 (1989) CEBAF Report No. 89-001; G. Faillon, IEEE Trans. Nucl. Sci. NS-32, 2945 (1985)].

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for bunching relativistic electrons comprising:

an electron injection gun for producing a pin beam of electrons;

a vacuum chamber, at least a portion of which is toroidally shaped, said vacuum chamber having a central axis defining an axial direction, said vacuum chamber comprised of an input cavity at a first end of the vacuum chamber having means for imparting a predetermined drift displacement to each electron of said electron beam passing therethrough such that electrons are caused to bunch together at a predetermined location in the vacuum chamber at a second end thereof, said input cavity disposed adjacent to said gun to receive electrons therefrom, and an output cavity disposed at essentially the second end of the toroidal portion having means for generating RF energy from the electrons passing therethrough;

means for producing an axial magnetic field in the axial direction in at least the toroidal portion of the vacuum chamber to maintain the electrons in the chamber, said axial field producing means disposed adjacent to the vacuum chamber;

means for producing a vertical magnetic field in a vertical direction perpendicular to the axial direction in the vacuum chamber to maintain the electrons in the chamber, said vertical field producing means disposed adjacent to the vacuum chamber; and a compression coil, said compression coil disposed adjacent to the output cavity to compress the electrons together.

2. An apparatus for bunching relativistic electrons comprising:

an electron injection gun for producing a pin beam of electrons;

a vacuum chamber, at least a portion of which is toroidally shaped, said vacuum chamber having a central axis defining an axial direction, said vacuum chamber comprised of an input cavity at a first end of the vacuum chamber having means for imparting a predetermined drift displacement by periodic transverse magnetic field modulation to each electron of said electron beam passing therethrough such that electrons are caused to bunch together at a predetermined location in the vacuum chamber at a second end thereof, said input cavity disposed adjacent to said gun to receive electrons therefrom, and an output cavity disposed at essentially the second end of the toroidal portion having means for generating RF energy from the electrons passing therethrough;

means for producing an axial magnetic field in the axial direction in at least the toroidal portion of the vacuum chamber to maintain the electrons in the chamber, said axial field producing means disposed adjacent to the vacuum chamber;

means for producing a vertical magnetic field in a vertical direction perpendicular to the axial direction in the vacuum chamber to maintain the electrons in the chamber, said vertical field producing means disposed adjacent to the vacuum chamber; and a compression coil, said compression coil disposed adjacent to the output cavity to compress the electrons together.

* * * * *